US011842873B2

(12) United States Patent
Mittelstadt

(10) Patent No.: US 11,842,873 B2
(45) **Date of Patent: *Dec. 12, 2023**

(54) TWO PIECE TRIP LEVER TO OPEN AND CLOSE CONTACTS REMOTELY

(71) Applicant: Schneider Electric USA, Inc., Andover, MA (US)

(72) Inventor: Chad R. Mittelstadt, Cedar Rapids, IA (US)

(73) Assignee: Schneider Electric USA, Inc., Boston, MA (US)

( * ) Notice: Subject to any disclaimer, the term of this patent is extended or adjusted under 35 U.S.C. 154(b) by 220 days.

This patent is subject to a terminal disclaimer.

(21) Appl. No.: 17/353,895

(22) Filed: Jun. 22, 2021

(65) Prior Publication Data

US 2022/0406549 A1 Dec. 22, 2022

(51) Int. Cl.
*H01H 71/12* (2006.01)
*H01H 71/52* (2006.01)

(52) U.S. Cl.
CPC ..... *H01H 71/12* (2013.01); *H01H 71/52* (2013.01)

(58) Field of Classification Search
CPC ..... H01H 71/12; H01H 71/52; H01H 71/10; H01H 71/24; H01H 83/20; H01H 71/66; H01H 2071/665
See application file for complete search history.

(56) References Cited

U.S. PATENT DOCUMENTS 4,297,663 A 10/1981 Seymour et al.
4,623,859 A 11/1986 Erickson et al.
5,834,997 A 11/1998 Fleege et al.
5,861,784 A * 1/1999 Heise ..... H01H 83/20 335/14
9,570,255 B2 * 2/2017 Gibson ..... H01H 69/01
9,607,797 B2 3/2017 Najera et al.
9,865,415 B2 1/2018 Mittelstadt
10,852,326 B2 12/2020 Fleege et al.
11,501,929 B1 * 11/2022 Fleege ..... H01H 3/26

FOREIGN PATENT DOCUMENTS

WO 2020139933 A1 7/2020

OTHER PUBLICATIONS

Extended European Search Report dated Nov. 18, 2022 for corresponding European Patent Application No. 22179796.2-1201, 12 pages.

* cited by examiner

*Primary Examiner* — Bernard Rojas
(74) *Attorney, Agent, or Firm* — Locke Lord LLP

(57) ABSTRACT

A modified trip lever for a remote controlled miniature circuit breaker comprises a trip lever and a separate kicker lever, which perform alternate functions to either automatically open the main contacts in response to a trip event or alternately open or close the contacts under remote control. The kicker lever rotates clockwise on a pivot in response to an actuator receiving a remote control open signal, to open the contacts by forcing a transverse tab on the kicker lever against a blade carrying a moveable main contact aligned with a stationary main contact. The kicker lever rotates counterclockwise to close the contacts in response to the actuator receiving a remote control close signal. The trip lever mounted on the same pivot, is configured to automatically open the contacts in response to a trip event, by pushing against the back side of the tab of the kicker lever.

16 Claims, 10 Drawing Sheets

TWO PIECE TRIP LEVER TO OPEN AND CLOSE CONTACTS REMOTELY

TECHNICAL FIELD

This invention is directed generally to circuit breakers and, more particularly, to remote control of a miniature circuit breaker to connect or disconnect electrical power by remote control or alternately to interrupt electrical power in response to a trip fault.

BACKGROUND

Circuit breakers are conventionally used to protect electric power distribution circuits against arcing faults, ground faults, short circuit faults, and/or overloads. Typically, miniature circuit breakers are used particularly to protect branch circuits in homes and in commercial and light industry applications. Banks of miniature circuit breakers are typically arranged in an electrical panel for manual switching of power to respective branch circuits. When an electrical utility outage occurs, critical loads such as pumps, security systems, refrigerators and electronics should ideally have an auxiliary source of power available. In residential and in commercial and light industry applications, back-up generators or photovoltaic systems with battery back-up are available to provide limited auxiliary power, which is typically at a lower power level than is available from the utility. When a utility outage occurs, some means is required to switch the reduced auxiliary power to the critical loads. A homeowner or manager of a commercial or light industry facility may be located at some distance from the power switching panels and may need to travel to the site of the panels to manually switch over to the auxiliary power.

When a major power outage occurs for an electrical utility, such as due to a severe weather event, the utility may have to impose controlled rolling cutoffs of electric service in an area by area sequence, because the demand for power in the region overwhelms the available generation. Such controlled rolling cutoffs, even for a few hours in each affected area, imposes a total blackout to each home or business and a risk to critical loads during the length of the outage. The ability of the electrical utility to remotely provide limited reserve power to branch circuits connected to critical loads in homes or businesses, would mitigate the damage typically incurred from controlled rolling cutoffs.

In an existing miniature circuit breaker, the existing trip lever includes a transverse tab that is integral with the trip lever, which kicks the blade in response to a trip event, to open the main contacts. In order to adapt a miniature circuit breaker to include a motor or other prime mover to drive the main contacts under remote control, problems arise in adding a secondary set of contacts, including cost, packaging, bi-stable latching designs, current withstand capability, and more. In arc fault (CAFI) circuit breakers, there is not sufficient room for an extra link between a motor and the blade, since the mechanism is thin and room is already allocated to other parts. Locating the blade in other locations within the miniature circuit breaker risks pollution, debris, or melted geometry, causing the blade or blade acting parts to jam up and not work.

What is needed, therefore, is a way for the trip lever to automatically interrupt current in response to a trip event or alternately to open or close the main contacts under remote control.

SUMMARY

In accordance with one example embodiment described herein, a modified trip lever for a remote controlled miniature circuit breaker performs alternate functions to either automatically open the main contacts in response to a trip event or alternately open or close the main contacts under remote control.

A kicker lever mounted on a pivot is configured to rotate clockwise in response to a remote control open signal, to open the main contacts by forcing a transverse tab on the kicker lever against a blade carrying a moveable main electrical contact aligned with a stationary main electrical contact. The kicker lever is configured to rotate counterclockwise to close the contacts in response to a remote control close signal.

A separate trip lever mounted on the same pivot as the kicker lever, is configured to automatically open the contacts in response to a trip event, by pushing against the back side of the transverse tab of the kicker lever. This causes the transverse tab to move in concert with the trip lever to push the front side of the transverse tab against the blade, to automatically open the contacts in response to the trip event.

In accordance with one example embodiment described herein, a modified trip lever for a remote controlled miniature circuit breaker, comprises:

a kicker lever pivotally mounted on a pivot in a housing of a miniature circuit breaker, having a first end and a second end on opposite sides of the pivot mounting of the kicker lever, with a transverse tab on the first end thereof configured to push a pivoted blade having a moveable main electrical contact that is aligned with a stationary main electrical contact mounted in the housing, to separate the moveable main contact from the stationary main contact, in response to an external control signal to open the main contacts; and a trip lever pivotally mounted on the same pivot as the kicker lever, configured to push against the transverse tab of the kicker lever to cause the transverse tab to move in concert with the trip lever to push the pivoted blade, to separate the moveable main contact from the stationary main contact, in response to a detection of a trip event by the miniature circuit breaker.

In accordance with one example embodiment described herein, the modified trip lever for a remote controlled miniature circuit breaker, further comprises:

the kicker lever being configured to rotate counterclockwise about its pivot when the main contacts are in the open position, so that the transverse tab of the kicker lever relieves pressure on the blade, and the blade is thereby forced by a blade spring bias to the closed position for the main contacts.

The resulting apparatus and system enables a modified trip lever in a miniature circuit breaker to perform alternate functions to either automatically open the main contacts in response to a trip event or alternately enable an actuator in the circuit breaker to open the main contacts under remote control. Examples of an actuator may include a motor, a solenoid, a spring, a pneumatically or hydraulically actuated piston, or other prime mover.

BRIEF DESCRIPTION OF THE DRAWINGS

A more detailed description of the disclosure, briefly summarized above, may be had by reference to various embodiments, some of which are illustrated in the appended drawings. While the appended drawings illustrate select embodiments of this disclosure, these drawings are not to be considered limiting of its scope, for the disclosure may admit to other equally effective embodiments.

FIG. 6A shows the state of main contacts closed, handle ON, trip lever and kicker lever in ON. FIG. 6B shows the state of main contacts open from remote control, handle in ON, trip lever in ON, kicker lever open, and toggle spring slightly rotated to follow blade. FIG. 6C shows the state of main contacts fully open from trip event, trip lever and kicker lever in TRIPPED, handle in TRIPPED, main toggle spring in TRIPPED, with the first end of the kicker lever remaining flush against the trip lever that is being pushed by the first end of the kicker lever, thereby pushing against the blade in response to a trip event, according to an example embodiment of the disclosure.

DETAILED DESCRIPTION

Figure 1:
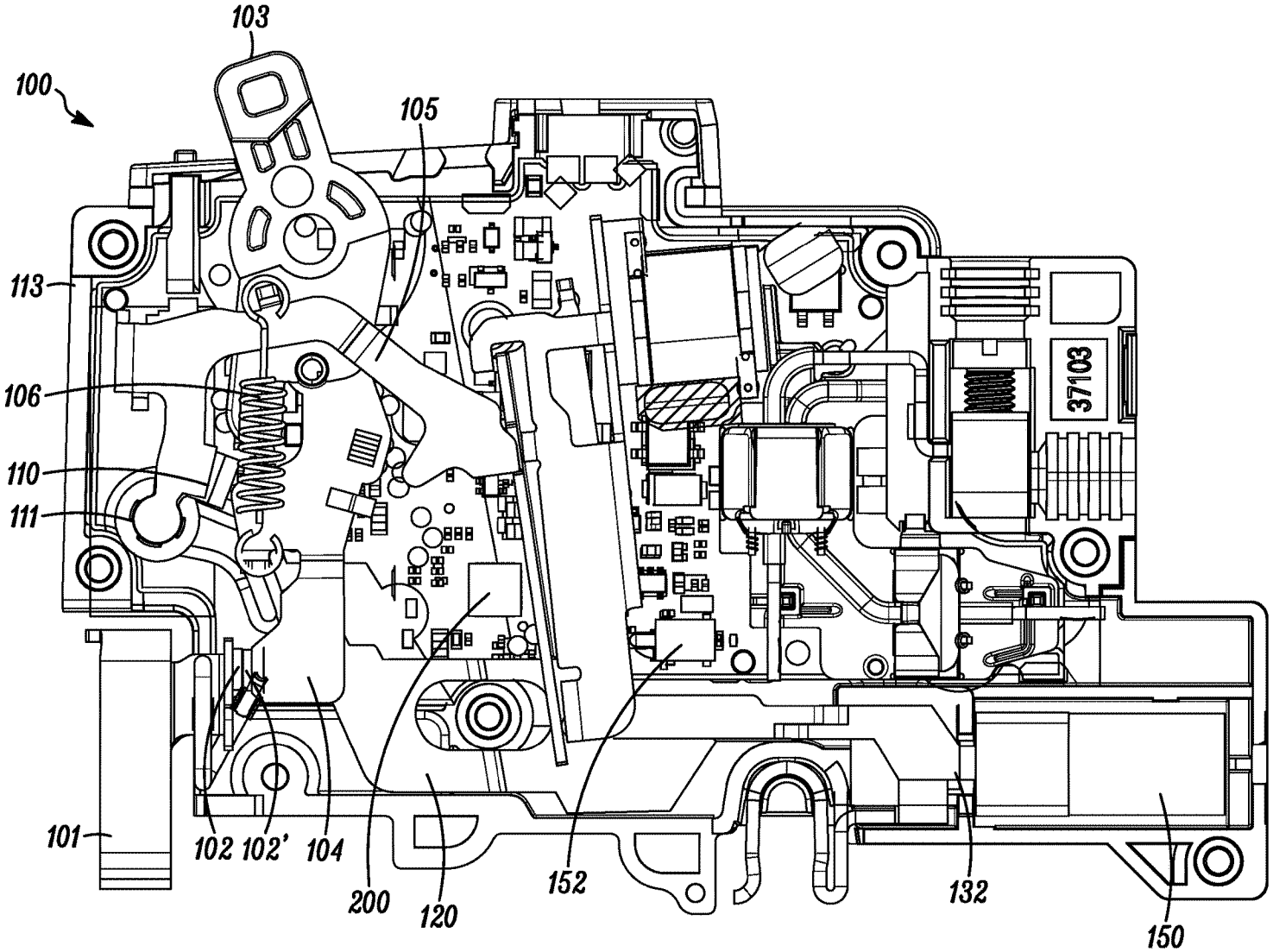
FIG. 1 is a side view of the overall inner organization of the miniature circuit breaker 100 with the cover and middle wall removed, according to an example embodiment of the disclosure.

FIG. 1 is a side view of the overall inner organization of the remote controlled miniature circuit breaker 100. A blade 104 is pivotally mounted on the handle 103 in the miniature circuit breaker housing 113, having a moveable main electrical contact 102' that is aligned with a stationary main electrical contact 102 mounted in the housing 113. The blade 104 is spring biased by a toggle spring 106 to pivot from an open position FIG. 2 for the main contacts 102, 102' to a closed position FIG. 3 for the main contacts 102, 102'. The blade 104 is pivotally mounted on the handle 103 to enable manual switching of the main contacts 102, 102'.

A kicker lever 108 is pivotally mounted on the pivot 111 in the housing and shares the same pivotal mounting 111 with the trip lever 105. In a miniature circuit breaker without the remote control function of an example embodiment of the disclosure, a trip lever 105' (FIG. 4A) includes a transverse tab 105" that performs a kicker function to knock the blade 104 from the closed position to the open position of the main contacts in response to a trip event.

In accordance with an example embodiment of the disclosure, the kicker function is broken out into a separate trip function that is activated to open the contacts in response to a trip event. The separate, remote control function to open the main contacts in response to an external control signal, is enabled by the kicker lever 108 of an example embodiment of the disclosure.

In an example embodiment of the disclosure, the kicker lever 108 has a first end 110 and a second end 112 (FIG. 2) on opposite sides of the pivotal mounting 111 of the kicker lever 108, with a transverse surface 110' (FIG. 2) on the first end 110 thereof configured to push or kick the blade 104 against the toggle spring 106 bias. When the main contacts 102, 102' are in the open position FIG. 2, if the kicker lever 108 rotates counterclockwise about its pivot 111, the transverse surface 110' of the kicker lever 108 relieves pressure on the blade 104, and the blade 104 is forced by the toggle spring 106 bias to the closed position FIG. 3 for the main contacts 102, 102'.

Figure 2:
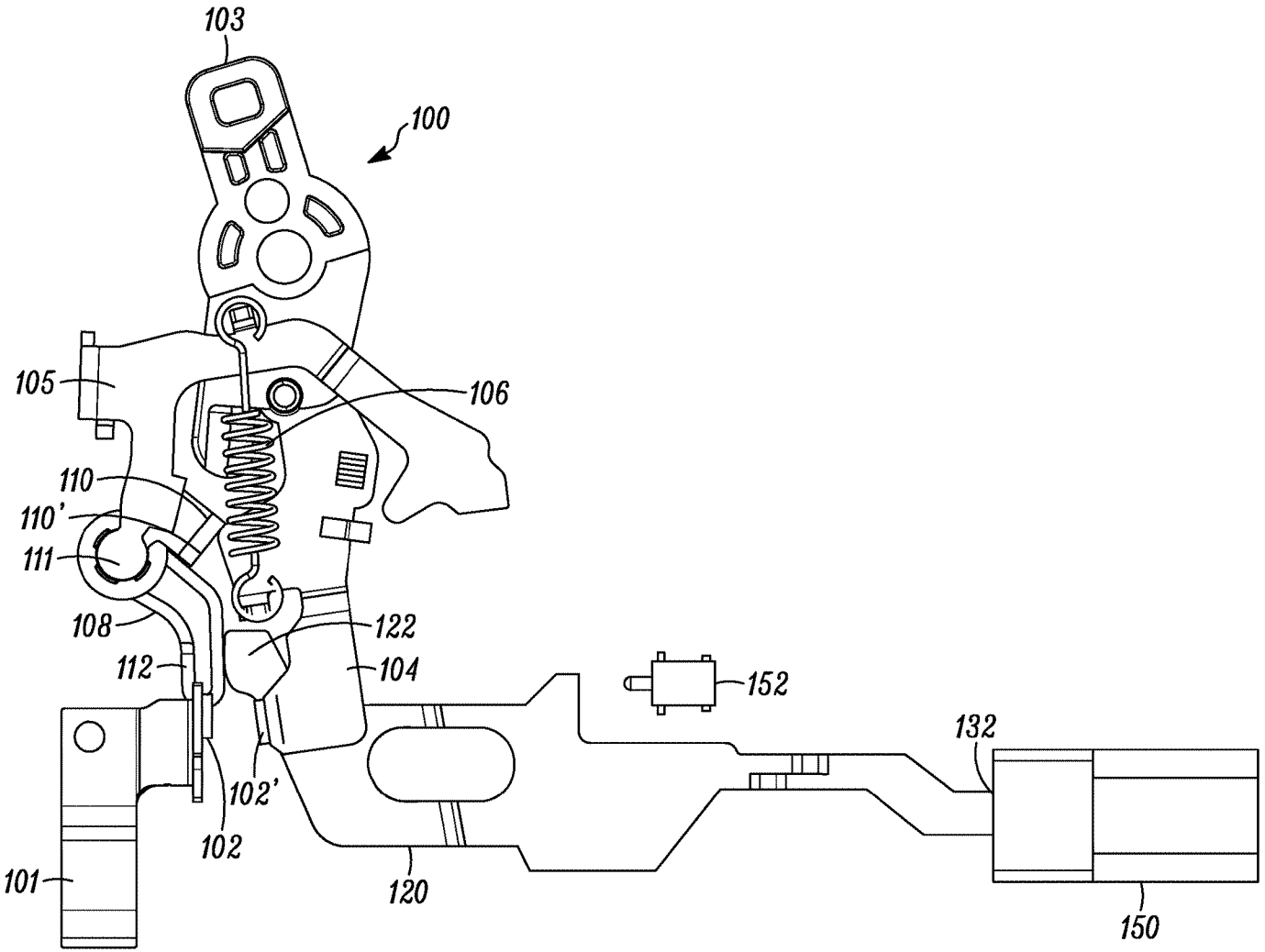
FIG. 2 is a side view of the inner organization of the components of the miniature circuit breaker 100, with the main contacts open in response to the slider plate depressing the kicker lever, according to an example embodiment of the disclosure.
Figure 3:
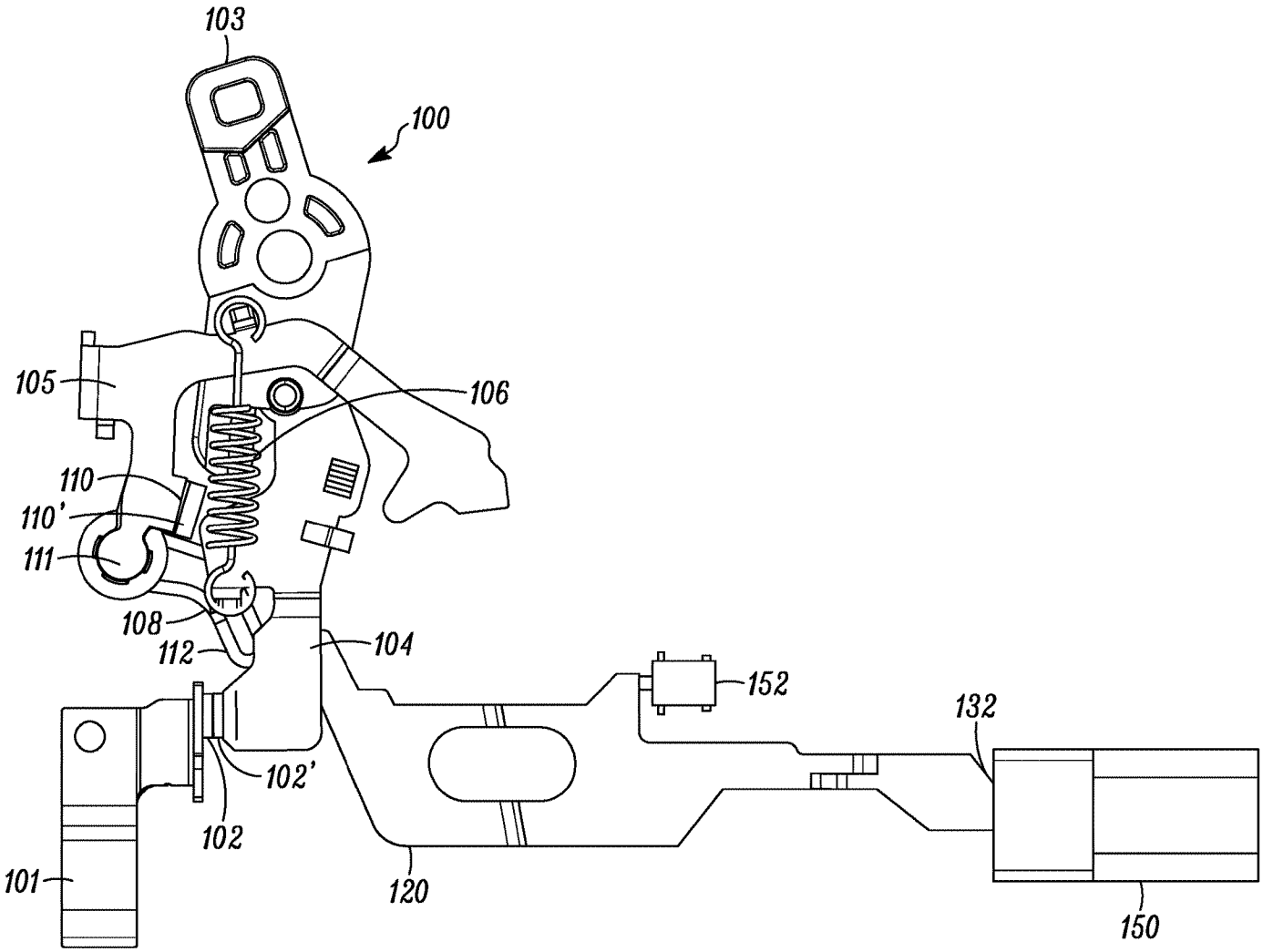
FIG. 3 is a side view of the inner organization of the components of the miniature circuit breaker 100, with the main contacts closed and a remote controlled signal received to open the main contacts by energizing the actuator to propel the slider plate toward the kicker lever to depress the kicker lever, according to an example embodiment of the disclosure.

A slider plate 120 is slidably mounted in the housing 113, and has an end surface 122 configured to push against the second end 112 of the kicker lever 108 to open the main contacts 102, 102', when the slider plate 120 moves toward the left, as shown in transitioning from the closed position in FIG. 3 to the open position in FIG. 2. When the end surface 122 of the slider plate 120 pushes the second end 112 of the kicker lever 108, the kicker lever 108 is caused to pivotally rotate clockwise about its pivotal mounting 111, to thereby push the transverse surface 110' of the first end 110 of the kicker lever 108 against the blade 104 to push or kick the blade 104 against the toggle spring 106 bias, thereby moving the main contacts 102, 102' from the closed position FIG. 3 to the open position FIG. 2. To summarize, in response to an external control signal to open the main contacts, the kicker lever 108 rotates clockwise about the pivot 111, and applies a force or a kick to the blade 104 to rotate the blade counter clockwise to open the main contacts 102, 102' and interrupt the flow of current.

To close the main contacts 102, 102', as shown in transitioning from the open position in FIG. 2 to the closed position in FIG. 3, the slider plate 120 moves toward the right and relieves pressure on the second end 112 of the kicker lever 108. In response, the kicker lever 108 rotates counterclockwise about its pivot 111, the transverse surface 110' of the kicker lever 108 relieves pressure on the blade 104, but the transverse surface 110' remains in contact with the blade, and the blade 104 is forced by the toggle spring 106 bias to the closed position FIG. 3 for the main contacts 102, 102'. The motion of the transverse surface 110' of the kicker lever 108 follows the spring-biased motion of the blade 104. To summarize, the kicker lever 108 rotates counterclockwise about the pivot 111, the blade 104 follows the kicker lever 108 in clockwise rotation until the main contacts 102, 102' are touching and current flows through the contacts.

An actuator 150 is mounted in the housing 113, configured to drive the slider plate 120. Examples of an actuator 150 may include an electric motor, a solenoid, a spring, a pneumatically or hydraulically actuated piston, or other prime mover. When an external control signal is received to close the main contacts 102, 102', from their open position shown in FIG. 2, the actuator 150 is thereby energized to pull the shaft 132 and cause the slider plate 120 to begin moving the end surface 122 of the slider plate 120 toward the right, away from the second end 112 of the kicker lever 108. In response the slider plate 120 moves toward the right and relieves pressure on the second end 112 of the kicker lever 108. In response, the kicker lever 108 rotates counterclockwise about its pivot 111, the transverse surface 110' of the kicker lever 108 relieves pressure on the blade 104, and the blade 104 is forced by the toggle spring 106 bias to the closed position of FIG. 3 for the main contacts 102, 102'. An example of a remote controlled circuit breaker that uses an electric motor as the actuator 150, is described in the copending U.S. patent application Ser. No. 17/353,888, filed Jun. 22, 2021, entitled "REMOTE CONTROLLED MINIATURE CIRCUIT BREAKER WITH HELICAL GEAR AND DC MOTOR", by Dennis W. Fleege, Salaheddine Faik, and Chad Mittelstadt, the entire disclosure of which is incorporated herein by reference.

An electrical position switch 152 mounted in the housing 113 is connected to a microcontroller 200 (FIG. 1) in the circuit breaker. The switch 152 is configured to engage and be activated by the motion of the slide plate 120 as it moves toward the actuator 150. When fully activated, the switch 152 signals the microcontroller to stop the actuator 150 when the main contacts 102, 102' have reached a desired closed position as shown in FIG. 3.

After the microcontroller receives an open command to open the main contacts 102, 102', the microcontroller energizes the actuator 150 to push the slider plate 120 and force the slider plate 120 to move leftward away from the actuator 150. The end surface 122 of the slider plate 120 moves toward and pushes against the second end 112 of the kicker lever 108, causing the kicker lever 108 to rotate clockwise. The clockwise rotation of the kicker lever 108 causes the transverse surface 110' of the first end 110 of the kicker lever 108 to pivot against and push or kick the blade 104, to move blade 104 against the toggle spring 106 bias, from the closed position of FIG. 3 for the main contacts 102, 102' to the open position of FIG. 2 for the main contacts 102, 102'.

Figure 4C:
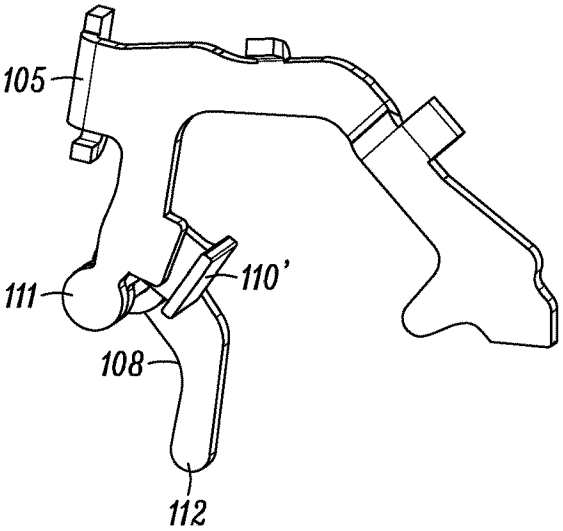
FIG. 4C is a perspective view of the two-part construction of the trip lever and the kicker lever in a remote control operation to open the main contacts, with the kicker lever pivoting to extend beyond the trip lever, thereby pushing against the blade in response to a remote control signal to open the main contacts by energizing the actuator to propel the slider plate to contact the second end of the kicker lever to push against the blade, thereby opening the main contacts, according to an example embodiment of the disclosure.
Figure 4B:
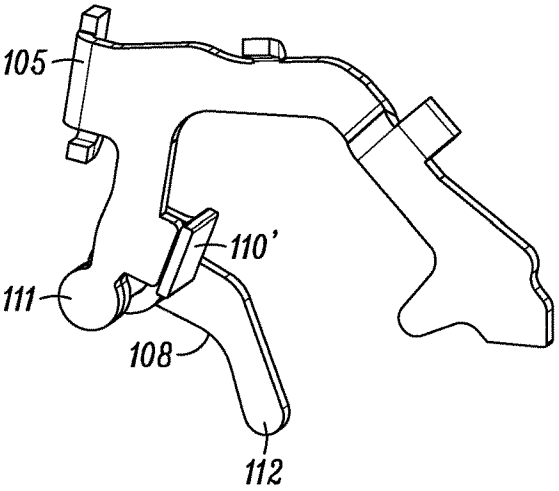
FIG. 4B is a perspective view of the two-part construction of the trip lever and the kicker lever in main contacts closed, ready to trip state, with the first end of the kicker lever remaining flush against the trip lever that is being pushed by the first end of the kicker lever, thereby pushing against the blade in response to a trip event, according to an example embodiment of the disclosure.
Figure 4A:
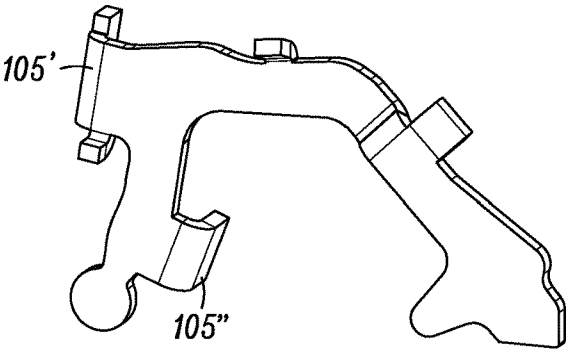
FIG. 4A Prior Art
FIG. 4A is a perspective view of an existing trip lever with the tab intact, which contacts the blade in response to a trip event.

FIG. 4A is a perspective view of an existing, prior art trip lever with the tab intact, which contacts the blade in response to a trip event. In a miniature circuit breaker without the remote control function of an example embodiment of the disclosure, a trip lever 105' (FIG. 4A) includes a transverse tab 105" that performs a kicker function to knock the blade 104 from the closed position to the open position of the main contacts in response to a trip event.

FIG. 4B is a perspective view of the two-part construction of the trip lever 105 and the kicker lever 108 in the ON or Tripped position with the first end 110 of the kicker lever 108 remaining flush against the trip lever 105. In response to a trip event, the trip lever 105 pushes against the first end 110 of the kicker lever 108. The first end 110 of the kicker lever 108 then pushes or kicks the blade 104, according to an example embodiment of the disclosure. The kicker function is broken out into a trip function that is activated to open the main contacts in response to a trip event. The trip lever 105 is pivotally mounted in the housing and separately mounted on a same pivot 111 as is mounted the kicker lever 108, the trip lever 105 being configured to push the first end 110 of the kicker lever 108 against the blade 104 to open the main contacts 102, 102' in a trip operation.

FIG. 4C is a perspective view of the two-part construction of the trip lever 105 and the kicker lever 108 in a remote control operation to open the main contacts. The separate, remote control function to open the main contacts in response to an external control signal, is enabled by the kicker lever 108 of an example embodiment of the disclosure. The kicker lever 108 has a first end 110 and a second end 112 on opposite sides of the pivotal mounting 111 of the kicker lever 108, with a transverse surface 110' on the first end 110 thereof configured to push or kick the blade 104 against the toggle spring 106 bias. When the end surface 122 of the slider plate 120 pushes the second end 112 of the kicker lever 108 as shown in FIG. 2, the kicker lever 108 is caused to pivotally rotate clockwise about its pivotal mounting 111, to thereby push the transverse surface 110' of the first end 110 of the kicker lever 108 against the blade 104 to push or kick the blade 104 against the toggle spring 106 bias, thereby moving the main contacts 102, 102' from the closed position of FIG. 3 to the open position of FIG. 2.

Figure 5C:
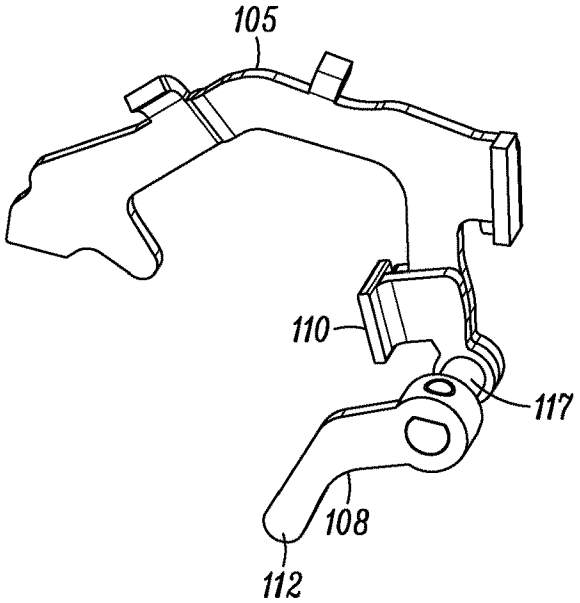
FIGS. 5A, 5B, and 5C are perspective front and rear views of the two-part construction of the trip lever and the kicker lever, according to an example embodiment of the disclosure.
Figure 5B:
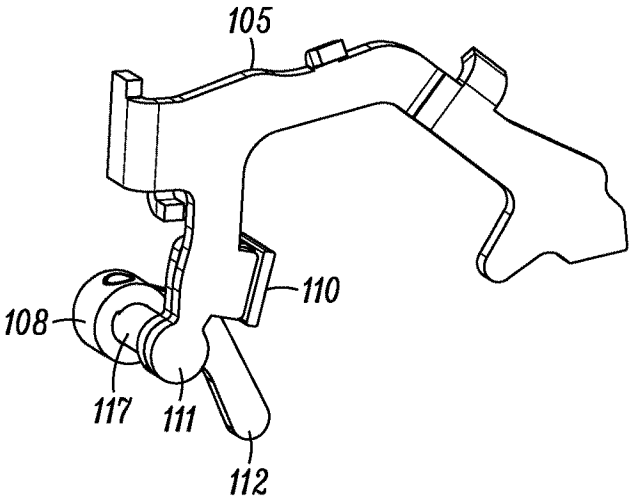
Figure 5A:
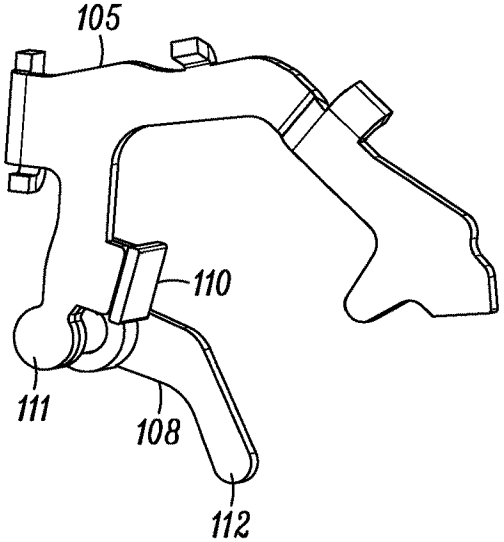
Figure 5D:
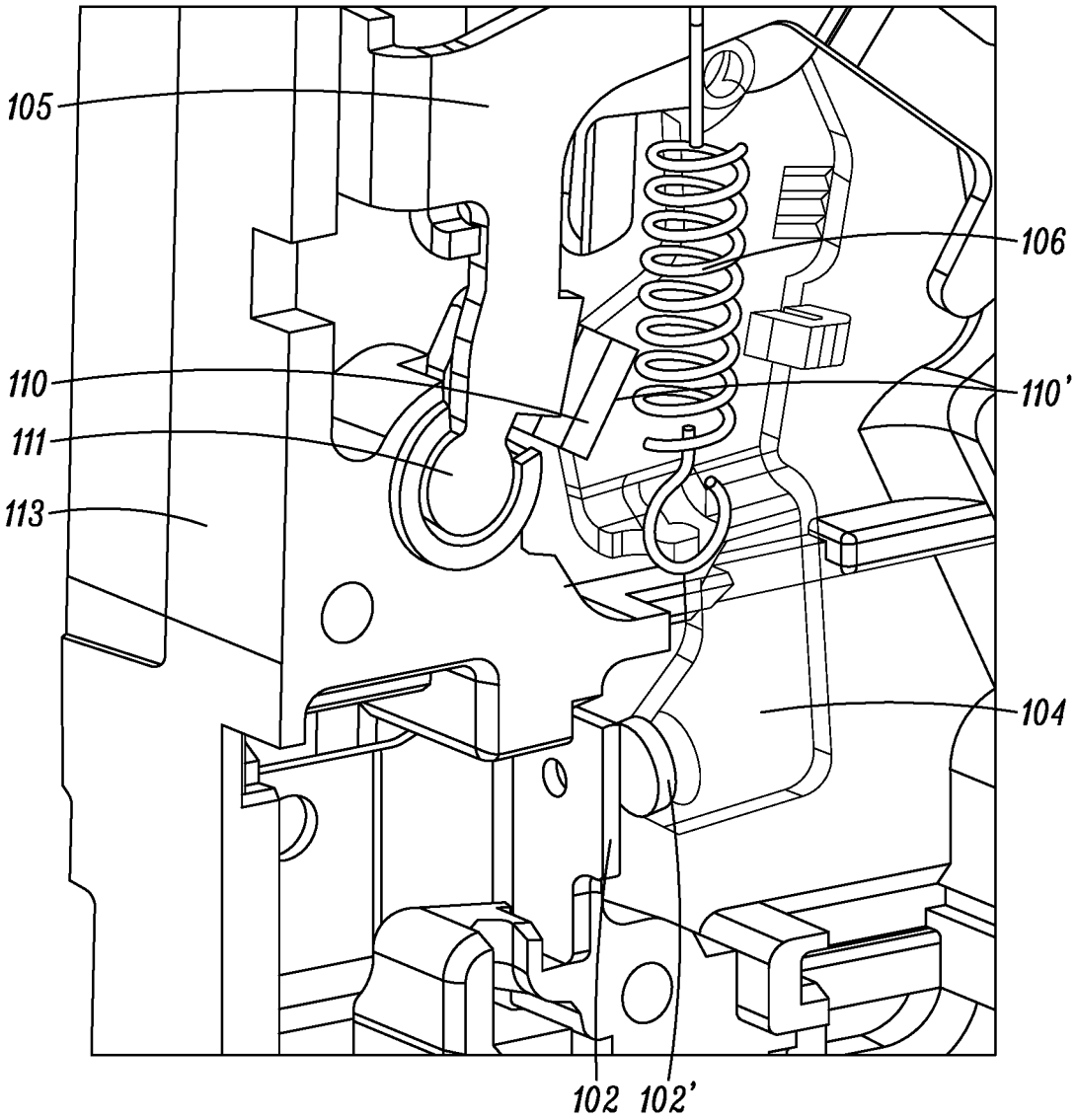
FIGS. 5D and 5E are close up full and cross sectioned perspective views of the trip lever and kicker lever pivot.
Figure 5E:
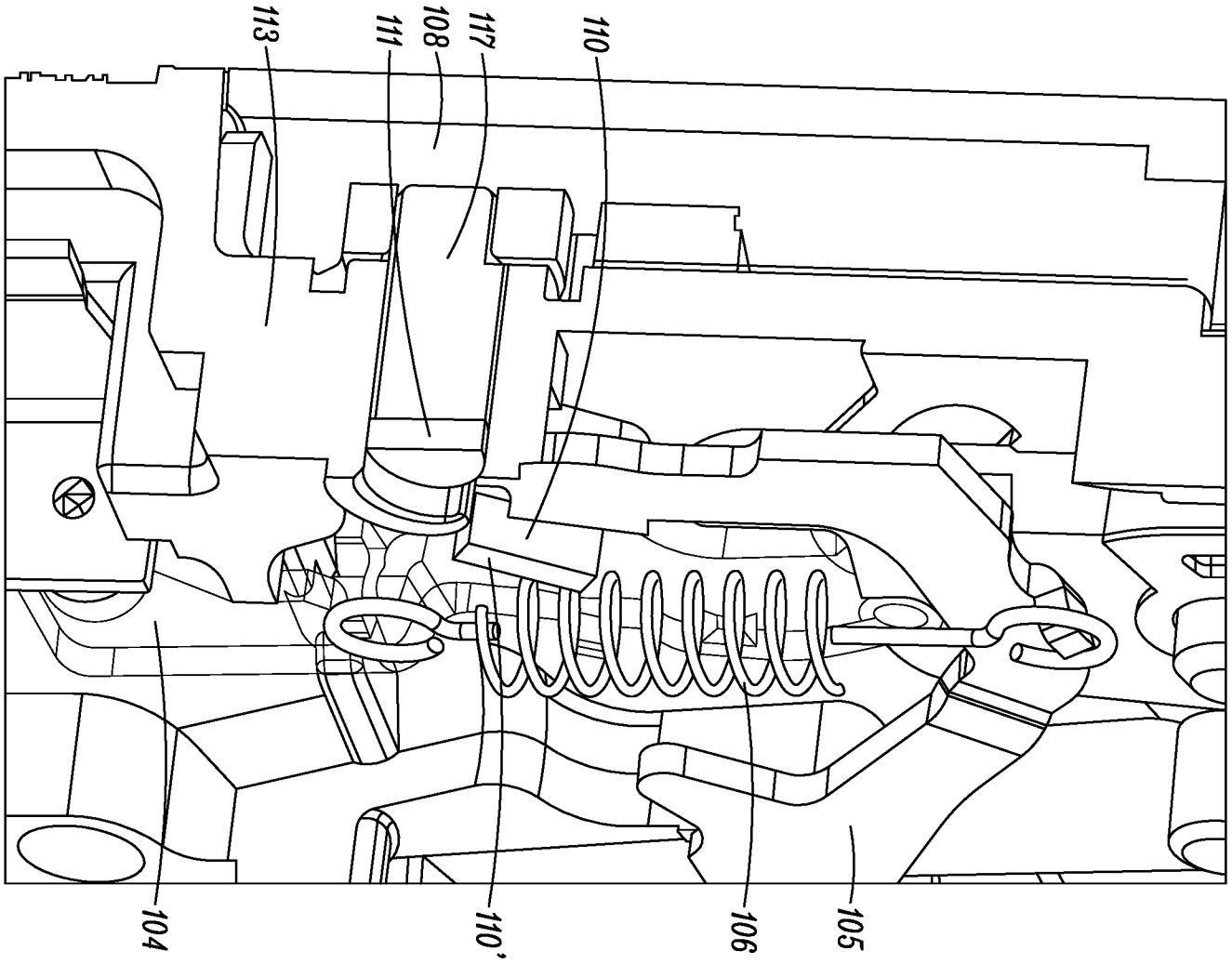

FIGS. 5A, 5B, 5C, 5D, and 5E are perspective views of the two-part construction of the trip lever 105 and the kicker lever 108, according to an example embodiment of the disclosure. The kicker lever 108 is pivotally mounted on the pivot 111 in the housing 113 and shares the same pivotal mounting 111 with the trip lever 105. A connecting shaft 117 that is coaxial with the pivot 111, joins the first end 110 of the kicker lever 108 with the second end 112, as shown in FIG. 5C. The shaft 117 is rotationally mounted in the housing 113, as shown in FIGS. 5D and 5E. The toggle bias spring 106 is a tension spring connected on one end to the blade 104 and on the other end to the trip lever 105, as shown in FIG. 5E.

Figure 6A:
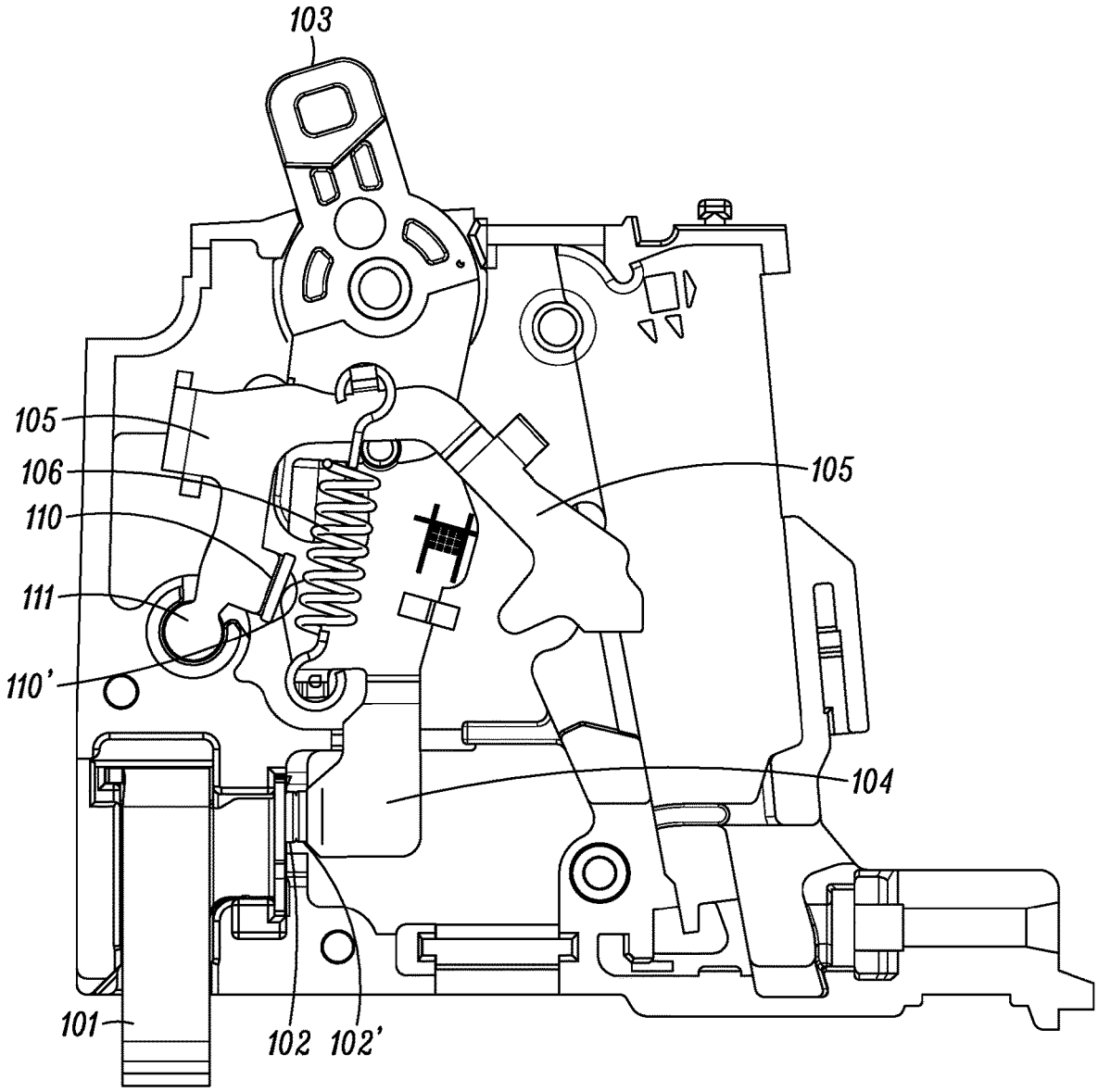
FIGS. 6A, 6B, and 6C show the positions of the trip lever, kicker lever, handle, blade, and toggle spring, respectively.
Figure 6B:
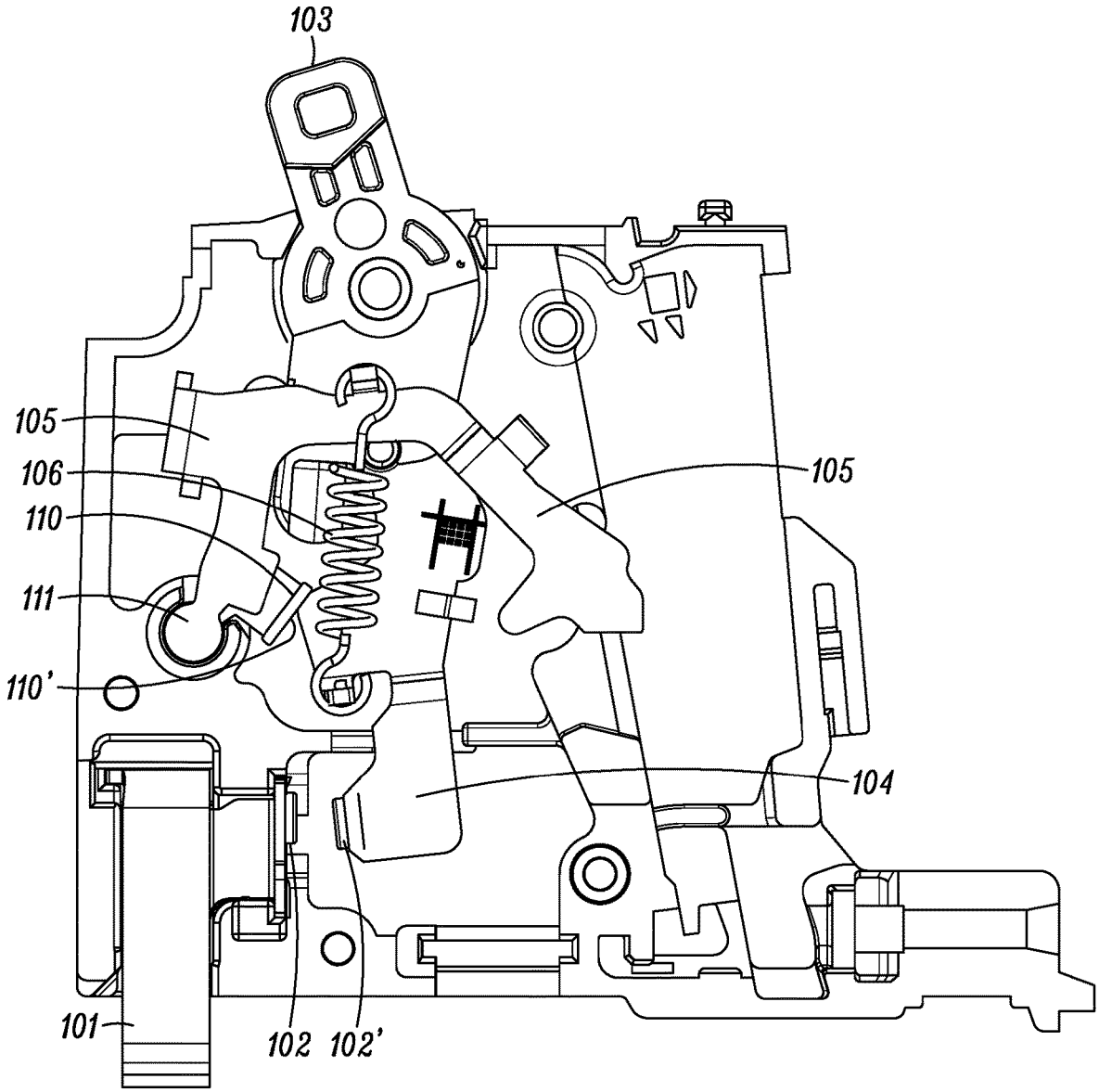
Figure 6C:
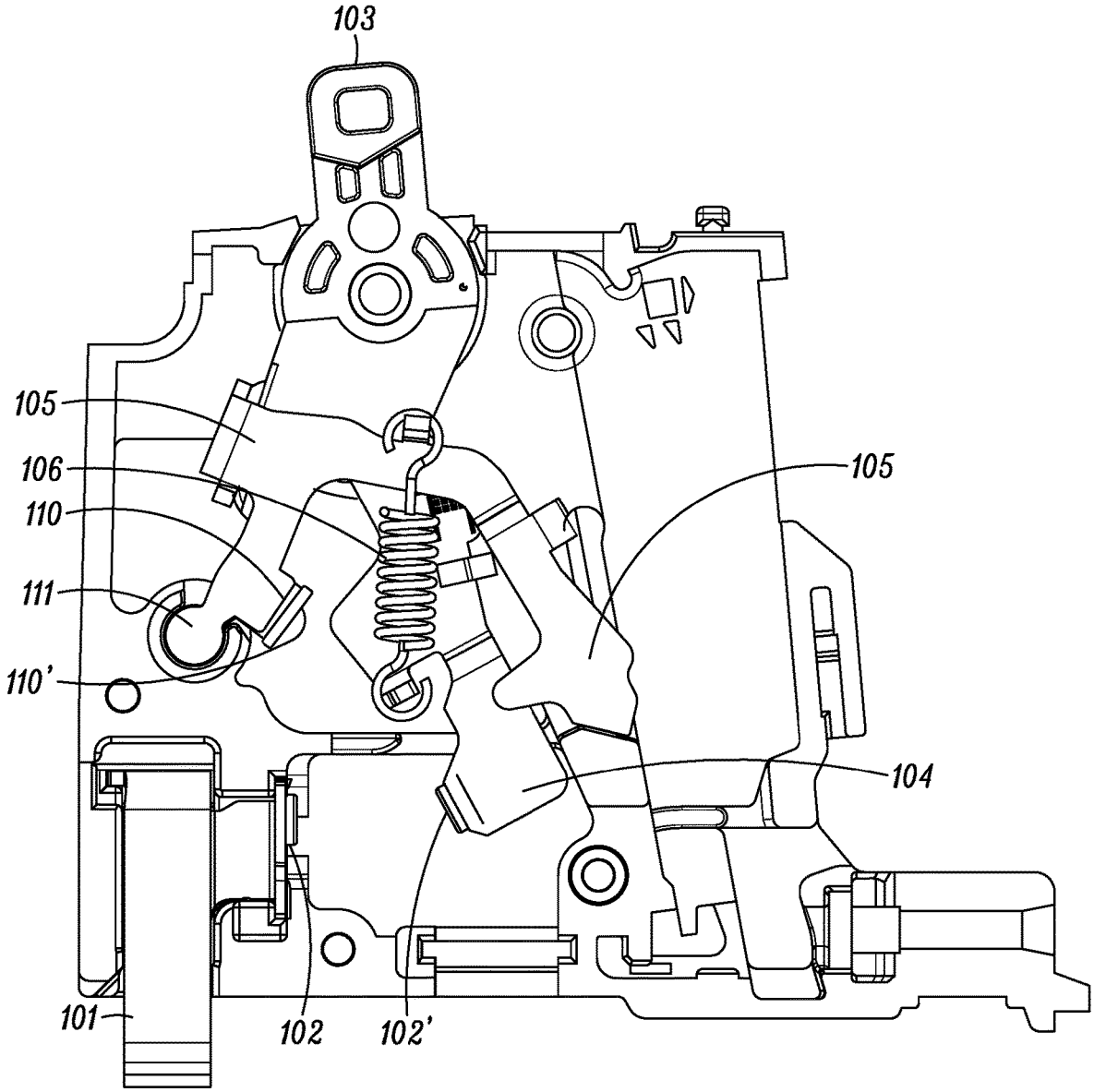

FIGS. 6A, 6B, and 6C show the positions of the trip lever, kicker lever, handle, blade, and toggle spring, respectively. FIG. 6A shows the state that the main contacts are closed, the handle is ON, the trip lever and the kicker lever are in ON. FIG. 6B shows the state that the main contacts are open from remote control, the handle is in ON, the trip lever is in ON, the kicker lever is open, and the toggle spring is slightly rotated to follow the blade. FIG. 6C shows the state that the main contacts are fully open from a trip event, the trip lever and kicker lever are in TRIPPED, the handle is in TRIPPED, the main toggle spring is in TRIPPED, with the first end of the kicker lever remaining flush against the trip lever, the first end of the kicker lever is pushed by the trip lever, thereby pushing against the blade in response to a trip event, according to an example embodiment of the disclosure.

The resulting apparatus and system enables a miniature circuit breaker to connect or disconnect electrical power by remote control or alternately to interrupt electrical power in response to a trip fault.

In the preceding, reference is made to various embodiments. However, the scope of the present disclosure is not limited to the specific described embodiments. Instead, any combination of the described features and elements, whether related to different embodiments or not, is contemplated to implement and practice contemplated embodiments. Furthermore, although embodiments may achieve advantages over other possible solutions or over the prior art, whether or not a particular advantage is achieved by a given embodiment is not limiting of the scope of the present disclosure. Thus, the preceding aspects, features, embodiments and advantages are merely illustrative and are not considered elements or limitations of the appended claims except where explicitly recited in a claim(s).

The various embodiments disclosed herein may be implemented as a system, method or computer program product.

Accordingly, aspects may take the form of an entirely hardware embodiment, an entirely software embodiment (including firmware, resident software, micro-code, etc.) or an embodiment combining software and hardware aspects that may all generally be referred to herein as a "component", "circuit," "module" or "system." Furthermore, aspects may take the form of a computer program product embodied in one or more computer-readable medium(s) having computer-readable program code embodied thereon.

Any combination of one or more computer-readable medium(s) may be utilized. The computer-readable medium may be a non-transitory computer-readable medium. A non-transitory computer-readable medium may be, for example, but not limited to, an electronic, magnetic, optical, electromagnetic, infrared, or semiconductor system, apparatus, or device, or any suitable combination of the foregoing. More specific examples (a non-exhaustive list) of the non-transitory computer-readable medium can include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. Program code embodied on a computer-readable medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages. Moreover, such computer program code can execute using a single computer system or by multiple computer systems communicating with one another (e.g., using a local area network (LAN), wide area network (WAN), the Internet, etc.). While various features in the preceding are described with reference to flowchart illustrations and/or block diagrams, a person of ordinary skill in the art will understand that each block of the flowchart illustrations and/or block diagrams, as well as combinations of blocks in the flowchart illustrations and/or block diagrams, can be implemented by computer logic (e.g., computer program instructions, hardware logic, a combination of the two, etc.). Generally, computer program instructions may be provided to a processor(s) of a general-purpose computer, special-purpose computer, or other programmable data processing apparatus. Moreover, the execution of such computer program instructions using the processor(s) produces a machine that can carry out a function(s) or act(s) specified in the flowchart and/or block diagram block or blocks.

The flowchart and block diagrams in the Figures illustrate the architecture, functionality and/or operation of possible implementations of various embodiments of the present disclosure. In this regard, each block in the flowchart or block diagrams may represent a module, segment or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It is to be understood that the above description is intended to be illustrative, and not restrictive. Many other implementation examples are apparent upon reading and understanding the above description. Although the disclosure describes specific examples, it is recognized that the systems and methods of the disclosure are not limited to the examples described herein but may be practiced with modifications within the scope of the appended claims. Accordingly, the specification and drawings are to be regarded in an illustrative sense rather than a restrictive sense. The scope of the disclosure should, therefore, be determined with reference to the appended claims, along with the full scope of equivalents to which such claims are entitled.

What is claimed is:

1. A modified trip lever for a remote controlled miniature circuit breaker, comprising:

a kicker lever configured to be pivotally mounted on a pivot in a housing of a miniature circuit breaker, having a first end and a second end on opposite sides of the pivot mounting of the kicker lever, with a transverse tab on the first end thereof configured to push a pivoted blade having a moveable main electrical contact that is aligned with a stationary main electrical contact mounted in the housing, to separate the moveable main contact from the stationary main contact, in response to an external control signal to open the main contacts; and a trip lever configured to be pivotally mounted on the same pivot as the kicker lever, configured to push against the transverse tab of the kicker lever to cause the transverse tab to move in concert with the trip lever to push the pivoted blade, to separate the moveable main contact from the stationary main contact, in response to a detection of a trip event by the miniature circuit breaker.

2. The modified trip lever for a remote controlled miniature circuit breaker of claim 1, further comprising:

the blade being spring biased by a toggle spring to pivot from an open position for the main contacts to a closed position for the main contacts.

3. The modified trip lever for a remote controlled miniature circuit breaker of claim 2, further comprising:

the kicker lever being configured to rotate counterclockwise about its pivot when the main contacts are in the open position, so that the transverse tab of the kicker lever relieves pressure on the blade, and the blade is thereby forced by the toggle spring bias to the closed position for the main contacts.

4. The modified trip lever for a remote controlled miniature circuit breaker of claim 3, further comprising:

a slider plate slideably mounted in the housing, having an end surface configured to push against the second end of the kicker lever to open the main contacts when the slider plate moves in transitioning from the closed position to the open position, thereby causing the end surface of the slider plate to push the kicker lever to pivotally rotate clockwise about its pivotal mounting, to thereby push the first end transverse tab of the kicker lever against the blade to push the blade against the toggle spring bias, thereby moving the main contacts from the closed position to the open position.

5. The modified trip lever for a remote controlled miniature circuit breaker of claim 4 further comprising:

the slider plate further configured to close the main contacts in transitioning from the open position to the closed position, by moving to relieve pressure on the second end of the kicker lever, thereby rotating the kicker lever counterclockwise about its pivot, the surface of the kicker lever thereby relieving pressure on the blade, the blade thereby forced by the blade spring bias to the closed position for the main contacts.

6. The modified trip lever for a remote controlled miniature circuit breaker of claim 5 further comprising:

an actuator mounted in the housing, configured to cause the slider plate to begin moving the end surface of the slider plate away from the second end of the kicker lever, thereby relieving pressure on the second end of the kicker lever, which thereby rotates counterclockwise about its pivot so that the surface of the kicker lever relieves pressure on the blade, and the blade is forced by the toggle spring bias to the closed position for the main contacts.

7. The modified trip lever for a remote controlled miniature circuit breaker of claim 6, further comprising:

the slider plate slideably mounted in the miniature circuit breaker, having an end surface configured to push against a second end of the kicker lever opposite to the first end, to open the main contacts when the slider plate moves in response to the remote control open signal, thereby causing the end surface of the slider plate to push the kicker lever to pivotally rotate clockwise about its pivotal mounting, to thereby push the first end transverse tab of the kicker lever against the blade to push the blade against the toggle spring bias, thereby opening the main contacts.

8. The modified trip lever for a remote controlled miniature circuit breaker of claim 7 further comprising:

the slider plate further configured to close the main contacts in response to the remote control close signal, by moving to relieve pressure on the second end of the kicker lever, thereby rotating the kicker lever counterclockwise about its pivot, the transverse tab of the kicker lever thereby relieving pressure on the blade, the blade thereby forced by the blade spring bias to close the main contacts.

9. A remote controlled miniature circuit breaker comprising the modified trip lever according to claim 1.

10. A remote controlled miniature circuit breaker comprising the modified trip lever according to claim 2.

11. A remote controlled miniature circuit breaker comprising the modified trip lever according to claim 3.

12. A remote controlled miniature circuit breaker comprising the modified trip lever according to claim 4.

13. A remote controlled miniature circuit breaker comprising the modified trip lever according to claim 5.

14. A remote controlled miniature circuit breaker comprising the modified trip lever according to claim 6.

15. A remote controlled miniature circuit breaker comprising the modified trip lever according to claim 7.

16. A remote controlled miniature circuit breaker comprising the modified trip lever according to claim 8.

* * * * *